United States Patent [19]

Bremer

[11] 4,170,869

[45] Oct. 16, 1979

[54] AIR OPERATED HOUR CLOCK

[76] Inventor: Edgar W. Bremer, P.O. Box 47, Okolona, Ohio 43550

[21] Appl. No.: 860,858

[22] Filed: Dec. 15, 1977

[51] Int. Cl.[2] ..... G04B 1/26

[52] U.S. Cl. ..... 58/42; 58/2

[58] Field of Search ..... 58/1 R, 2, 42; 92/32, 92/33, 55

[56] References Cited

U.S. PATENT DOCUMENTS

| | | | |
|---|---|---|---|
| 2,930,362 | 3/1960 | Riester | 92/33 |
| 3,117,413 | 1/1964 | Pulaski | 58/42 |
| 3,625,126 | 12/1971 | Land | 58/42 |

*Primary Examiner*—B. Dobeck
*Assistant Examiner*—William L. Feeney

[57] ABSTRACT

This clock consists primarily of a main body to which is attached an air connection, on one end. Within the main body is a toothed piston rotor with spaced-apart indentations that removably receive a pair of drive screws in the base of the main body. The piston rotor is spring loaded on a central shaft, and a toothed cap is pinned in the bore of the main body. When air enters the main body, the piston rotor, the shaft and the hour hand are forced up, and the teeth turn this unit twenty-two degrees. When the air is turned off, the spring returns this unit to the base and forces the unit onto the drive screws of the main body, which turns the unit another eight degrees. This cycle advances the hour hand one hour, which is indicated by means of the radially spaced drive screws in the toothed cap.

1 Claim, 4 Drawing Figures

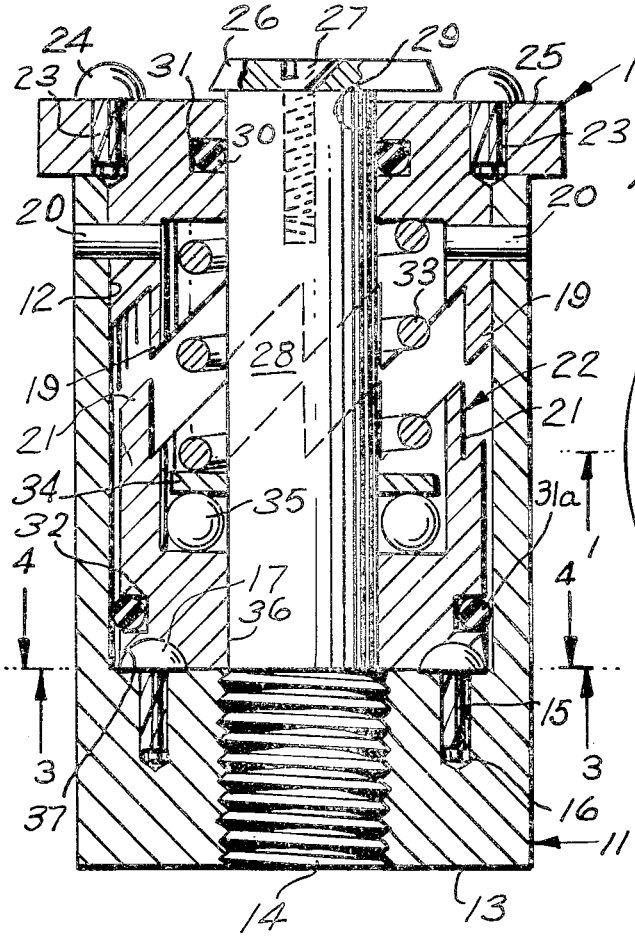
FIG. 1
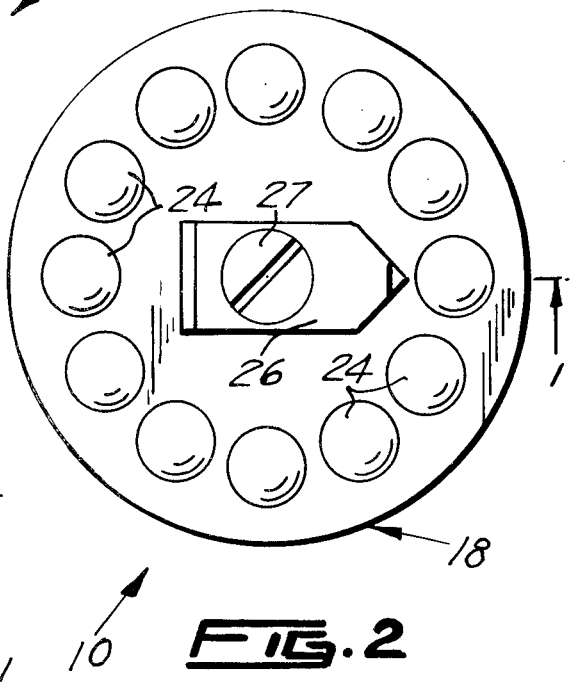
FIG. 2
FIG. 3
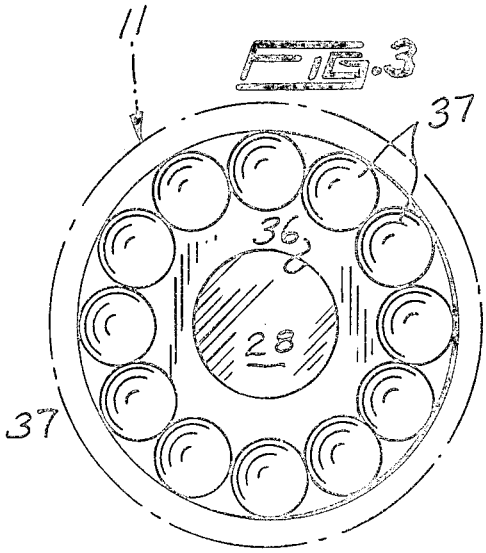
FIG. 4
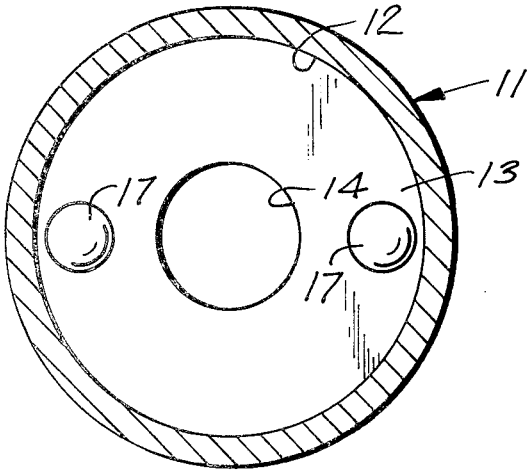

AIR OPERATED HOUR CLOCK

This invention relates to clocks, and more particularly to an air operated hour clock.

It is, therefore, the principal object of this invention to provide an air operated hour clock, which operates by means of compressed air.

Another object of this invention is to provide an air operated hour clock, which has a toothed piston rotor, which, by a central shaft, will be urged upwards to engage teeth of the cap of the device, thus rotating the shaft and its attached pointer arm.

A further object of this invention is to provide an air operated hour clock, which will have its shaft and piston rotor spring loaded for return to the base of the main body after moving the pointer arm a one hour gradiation on the cap of the assembly.

Other objects of the invention are to provide an air operated hour clock, which is simple in design, inexpensive to manufacture, rugged in construction, easy to use and efficient in operation.

These, and other objects, will be readily evident, upon a study of the following specification, and the accompanying drawing, wherein:

FIG. 1 is a transverse view, taken along the line 1—1 of FIG. 2;

FIG. 2 is a greatly enlarged, top plan view of the present invention;

FIG. 3 is a transverse view, taken along the line 3—3 of FIG. 1, and shows the main body of the invention in phantom, and FIG. 4 is a transverse view, taken along the line 4—4 of FIG. 1.

According to this invention, a clock 10 is shown to include a main body 11 having a cylindrical bore 12, and the end wall 13 of main body 11 is provided with a threaded opening 14, for receiving an air attachment. A pair of spaced-apart drive screws 15 are fixedly secured in the openings 16 of end wall 13, and the heads 17 extend, for a purpose which hereinafter will be described.

A cap 18 having twelve forty five degree sawteeth 19, is pinned to the main body 11, by means of a pair of pins 20. Twelve forty five degree sawteeth 21, on end of piston rotor 22, provide for engagement with teeth 19 of cap 18, when clock 10 is in operation. Cap 18 is provided with twelve equally and radially spaced-apart drive pins 23, of which the heads 24 thereof extend above the face 25 of cap 18, so as to provide one hour indication means for clock 10, with respect to the pointer arm 26, which is secured, by screw fastener 27, to shaft 28. Shaft 28 is freely and slidably received within opening 29 of cap 18, and an "O" ring 30, in annular groove 31, provides seal means against the outer periphery of shaft 28. A similar "O" ring 31*a*, is received in annular groove 32 of piston rotor 22, for providing sealing means against the inner periphery of bore 12 of main body 11.

A return spring 33, receiving shaft 28, abuts at one end with cap 18, and abuts at its opposite end with washer 34, which rides on thrust bearing 35. Shaft 28 is fixedly secured within opening 36 of piston rotor 22. In the normal rest position, a pair of the plurality of circular indentations 37 are in engagement with the pair of heads 17 of drive screws 15.

After an air connection is screwed into opening 14, and the air is turned on, the piston rotor 22, the shaft 28 and its pointer arm 26 are forced upwards by the air under pressure. The teeth 21, of piston rotor 22, slidingly engage the teeth 19 of cap 18, and thus rotate shaft 28, and its pointer arm 26, twenty two degrees. When the air is turned off, the spring 33 returns the piston rotor 22 and shaft 28 to end wall 13, which rotates piston rotor 22 another eight degrees. This cycle advances the pointer arm 26 one hour. The above mentioned causes a pair of heads 17, of drive screws 15, to seat within a pair of the indentations 37.

While various changes may be made in the detail construction, it is understood that such changes will be within the spirit and scope of the present invention, as is defined by the appended claims.

It is to be noted, that the teeth of the piston rotor co-operate with the teeth of the end cap, in the following manner. When the air is turned on, the piston is pushed up and rotated by interaction of the teeth. When the air is turned off, and the piston goes down, the piston is further rotated by the interaction of the drive screw heads 17 and indentations 37 of the piston. Thus, this further rotation serves to properly line up the piston sawteeth for the next cycle.

It is also to be noted, that the air pressure control valve, for the operation of clock 10, is conventional, and common in the art.

What I now claim is:

1. An air operated hour clock, comprising a hollow cylindrical main body, which receives air under pressure, a toothed piston rotor slidably received in said cylindrical main body for intermittent engagement with similar teeth of a cap secured to one end of said main body, a shaft with spring return means secured in said toothed piston rotor, and the engagement of the teeth of said toothed piston rotor with the teeth of said cap provides rotation of said shaft and a pointer arm secured to the external end of said shaft; said main body being secured fixedly at its open end to said cap by a pair of oppositely opposed pins and the end walls of said main body threadingly receives a compressed air attachment through which air under pressure operates said clock, and said shaft is fixedly secured, at one end, in said toothed piston rotor, and is freely and slidably received in an opening of said cap, at its opposite end, the opening of said toothed piston rotor, and the opening of said cap receiving said shaft, being positioned along the longitudinal axis of said main body, and said pointer arm is secured rigidly to the extending portion of said shaft by suitable fastener means; the outer face of said cap being provided with a plurality of radially and equally spaced-apart drive screws, which are fixedly secured in openings of said cap, the heads of said drive screws serving as one-hour indication means through the rotation of said pointer arm, and said spring return means for said shaft comprises a coil spring received freely on the outer periphery of said shaft, and said spring abuts at one end with the inner face of said cap, and abuts at its opposite end with a washer in engagement with a thrust bearing received within said toothed piston rotor, and when said shaft and said toothed piston rotor are urged towards said cap by air under pressure, the said teeth of said toothed piston rotor camingly engage with the said teeth of said toothed cap, thus rotating said shaft, and its attached said toothed piston rotor, a predetermined number of degrees, which is indicated by means of said pointer arm with respect to the said heads extending from said cap; the pressure of air, after being released, causes said spring to urge said toothed piston rotor away from said toothed cap, and returns said toothed rotor to the end wall of said main body; and the downward force of said spring causes a pair of a plurality of indentations, on a face of said toothed piston rotor, to camingly engage with a pair of heads of drive pins fixedly secured in the said end wall of said main body, which rotates said toothed piston rotor another predetermined number of degrees prior to said piston rotor seating on said end wall.

* * * * *